US007717632B2

(12) United States Patent
Lien et al.

(10) Patent No.: US 7,717,632 B2
(45) Date of Patent: May 18, 2010

(54) CARD PRINTER PRINTHEAD MOUNTING

(75) Inventors: Brent D. Lien, Minneapolis, MN (US); Thomas G. Gale, Jr., Robbinsdale, MN (US); Ted M. Hoffman, Eden Prairie, MN (US); John P. Skoglund, Savage, MN (US); Andy A. Vander Woude, Eden Prairie, MN (US)

(73) Assignee: HID Global Corporation, Irvine, CA (US)

( * ) Notice: Subject to any disclaimer, the term of this patent is extended or adjusted under 35 U.S.C. 154(b) by 0 days.

(21) Appl. No.: 12/181,455

(22) Filed: Jul. 29, 2008

(65) Prior Publication Data

US 2008/0279602 A1 Nov. 13, 2008

Related U.S. Application Data

(63) Continuation of application No. 11/823,034, filed on Jun. 26, 2007, now abandoned, which is a continuation of application No. 10/936,885, filed on Sep. 9, 2004, now abandoned.

(60) Provisional application No. 60/502,535, filed on Sep. 12, 2003.

(51) Int. Cl.
*B41J 25/308* (2006.01)
*B41J 25/304* (2006.01)

(52) U.S. Cl. ..... 400/120.17; 400/120.16; 347/197; 347/198

(58) Field of Classification Search ..... None
See application file for complete search history.

(56) References Cited

U.S. PATENT DOCUMENTS

| | | | | |
|---|---|---|---|---|
| 3,623,933 A | | 11/1971 | Staats | 156/552 |
| 4,060,441 A | | 11/1977 | Ohta et al. | 156/234 |
| 4,276,112 A | | 6/1981 | French et al. | 156/360 |
| 4,387,000 A | | 6/1983 | Tancredi | 156/495 |
| 4,619,728 A | | 10/1986 | Brink | 156/555 |
| 4,878,773 A | | 11/1989 | Mazumder | 400/234 |
| 4,924,240 A | | 5/1990 | Herbert et al. | 347/217 |
| 5,044,801 A | * | 9/1991 | Uchimura et al. | 400/692 |
| 5,220,343 A | | 6/1993 | Takanashi et al. | 346/1.1 |

(Continued)

FOREIGN PATENT DOCUMENTS

| | | |
|---|---|---|
| EP | 1 486 342 | 2/1998 |

(Continued)

OTHER PUBLICATIONS

Machine translation of JP 11-300830 to Toppan Printing Co. from Japanese Patent Office website, Nov. 1999.

(Continued)

*Primary Examiner*—Daniel J Colilla
(74) *Attorney, Agent, or Firm*—Westman, Champlin & Kelly, P.A.

(57) ABSTRACT

A card printer comprises a print platen, a first support, a printhead, and a biasing component. The first support is moveable, relative to the platen, between print and withdrawn positions. The printhead is moveably mounted to the first support for movement between a forward position and a floating position relative to the first support. The biasing component is configured to apply a biasing force to bias the printhead toward the forward position.

17 Claims, 16 Drawing Sheets

U.S. PATENT DOCUMENTS

| | | | | | |
|---|---|---|---|---|---|
| 5,294,203 | A | | 3/1994 | Williams | 400/234 |
| 5,368,677 | A | | 11/1994 | Ueda et al. | 156/362 |
| 5,480,509 | A | | 1/1996 | Matsuo et al. | 156/522 |
| 5,554,250 | A | | 9/1996 | Dais et al. | 156/353 |
| 5,584,962 | A | | 12/1996 | Bradshaw et al. | 156/495 |
| 5,594,487 | A | * | 1/1997 | Nuita et al. | 347/197 |
| 5,600,362 | A | | 2/1997 | Morgavi et al. | 347/218 |
| 5,674,013 | A | * | 10/1997 | Koike et al. | 400/120.16 |
| 5,783,024 | A | | 7/1998 | Forkert | 156/351 |
| 5,820,277 | A | | 10/1998 | Schulte | 400/223 |
| 5,825,392 | A | * | 10/1998 | Mochizuki | 347/197 |
| 6,010,258 | A | | 1/2000 | Tomita et al. | 400/120.02 |
| 6,094,209 | A | | 7/2000 | Nardone et al. | 347/171 |
| 6,095,220 | A | | 8/2000 | Kobayashi et al. | 156/540 |
| 6,105,861 | A | | 8/2000 | Kuit | 235/375 |
| 6,176,286 | B1 | | 1/2001 | Kitagawa et al. | 156/555 |
| 6,325,607 | B1 | | 12/2001 | Atake | 425/122 |
| 6,352,095 | B1 | | 3/2002 | Fulmer | 156/387 |
| 6,386,772 | B1 | | 5/2002 | Klinefelter et al. | 400/208 |
| 6,640,717 | B2 | | 11/2003 | Kosaka et al. | 101/487 |
| 6,644,802 | B2 | | 11/2003 | Minowa | 347/105 |
| 6,646,666 | B2 | | 11/2003 | Matsuoka | 347/213 |
| 2001/0053947 | A1 | | 12/2001 | Lenz et al. | 700/117 |
| 2002/0088553 | A1 | | 7/2002 | Whitby | 156/556 |
| 2004/0071487 | A1 | | 4/2004 | Ono et al. | 400/120.01 |
| 2004/0075730 | A1 | * | 4/2004 | Tsuruta | 347/171 |

FOREIGN PATENT DOCUMENTS

| | | | |
|---|---|---|---|
| JP | 07039644 | A | 2/1995 |
| JP | 1268457 | A | 10/1999 |
| JP | 11300830 | A | 11/1999 |
| WO | WO 9619355 | A1 | 6/1996 |

OTHER PUBLICATIONS

Machine translation of JP 07-39644 to Takase et al. from Japanese Patent Office website, Feb. 1995.
U.S. Appl. No. 10/418,730, filed Apr. 18, 2003.

* cited by examiner

CARD PRINTER PRINTHEAD MOUNTING

CROSS-REFERENCE TO RELATED APPLICATION

The present application is a continuation of U.S. patent application Ser. No. 11/823,034, filed Jun. 26, 2007 now abandoned and U.S. patent application Ser. No. 10/936,885, filed Sep. 9, 2004 now abandoned; and the present application claims the benefit of U.S. provisional patent application Ser. No. 60/502,535, filed Sep. 12, 2003. The content of each of the above-referenced applications is hereby incorporated by reference in its entirety.

BACKGROUND OF THE INVENTION

The present invention generally relates to a card printer, such as an identification card printer. Some aspects of the present invention relate to reverse-image identification card printers.

Reverse-image identification card printers generally utilize an intermediate transfer film or ribbon on which an image is printed by a printhead. The printhead is typically a thermal printhead that operates to heat different colored dye panels of a thermal print ribbon to transfer the colored dye from the print ribbon to a panel of transfer film and form the image thereon. The printed image on the transfer film is then registered with a card or other substrate and the image is transferred to a surface of the card from the transfer film.

Such reverse-image identification card printers are complicated devices and improvements are in continuous demand. For example, there is a continuous demand for improved reliability and improved print quality. Additionally, there are demands for improving the process by which the print and transfer ribbons are loaded. Finally, there are demands to make the printers more compact.

SUMMARY OF THE INVENTION

Embodiments of the present invention relate to a card printer comprising a moveable printhead mounting. In accordance with one embodiment, the card printer comprises a print platen, a first support, a printhead, and a biasing component. The first support is moveable, relative to the platen, between print and withdrawn positions. The printhead is moveably mounted to the first support for movement between a forward position and a floating position relative to the first support. The biasing component is configured to apply a biasing force to bias the printhead toward the forward position.

Another embodiment of the invention is directed to a card printer comprising a platen, a first support, a printhead, a cam member and a motor. The first support is moveable, relative to the platen, between print and withdrawn positions. The printhead is mounted to the first support and applies a pressure to the platen when the first support is in the print position and is displaced from the platen when the first support is in the withdrawn position. The cam member engages the first support and moves the first support between the print and withdrawn positions in response to rotation of the cam member. The motor is configured to drive the rotation of the cam member.

Other features and benefits that characterize embodiments of the present invention will be apparent upon reading the following detailed description and review of the associated drawings.

DETAILED DESCRIPTION OF THE PREFERRED EMBODIMENTS

ID Card Printer Overview

Figure 1:
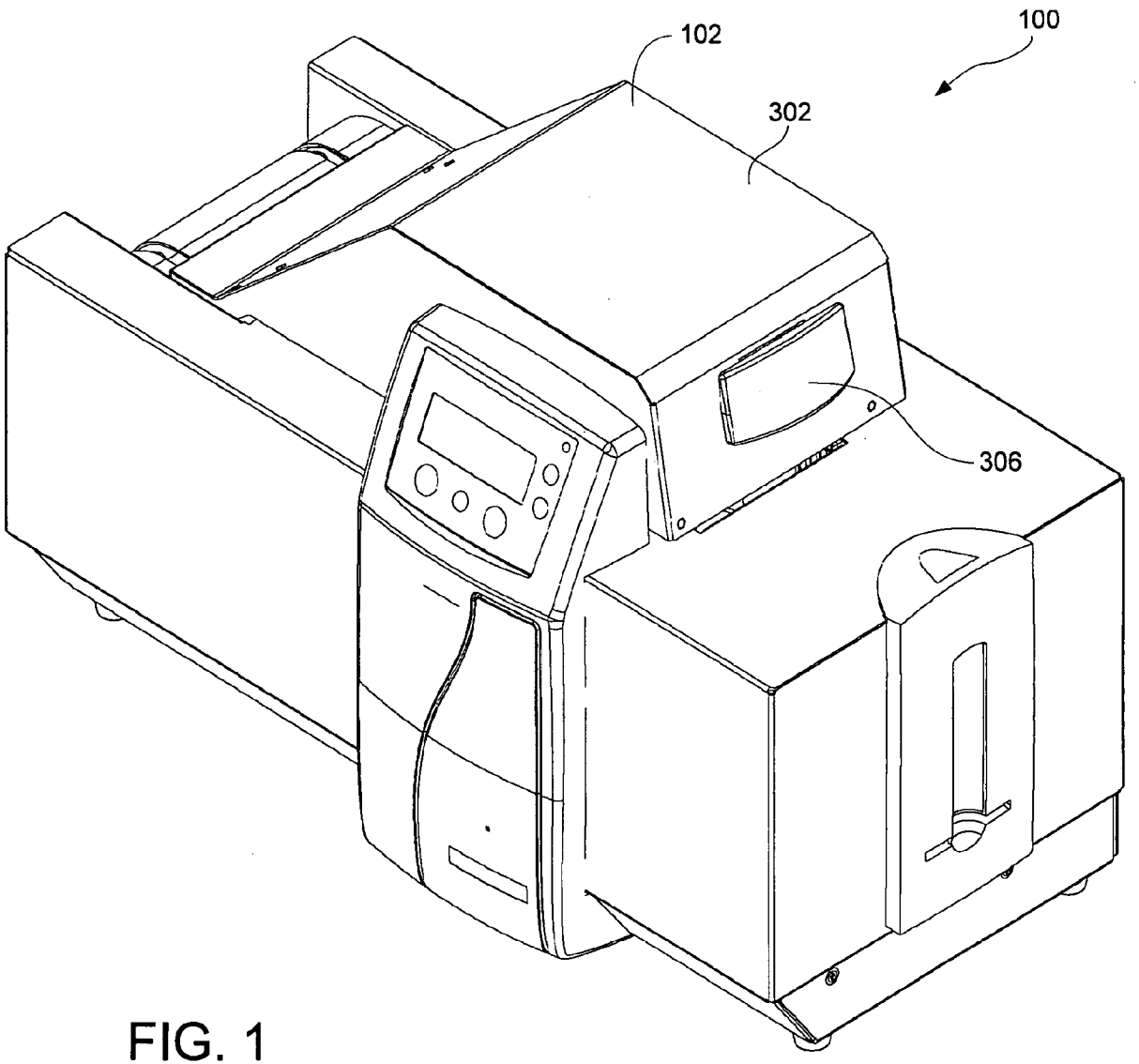
FIGS. 1 and 2 are perspective views of an exemplary identification card printer having a swing arm assembly respectively in closed and opened positions, in accordance with embodiments of the invention.
Figure 2:
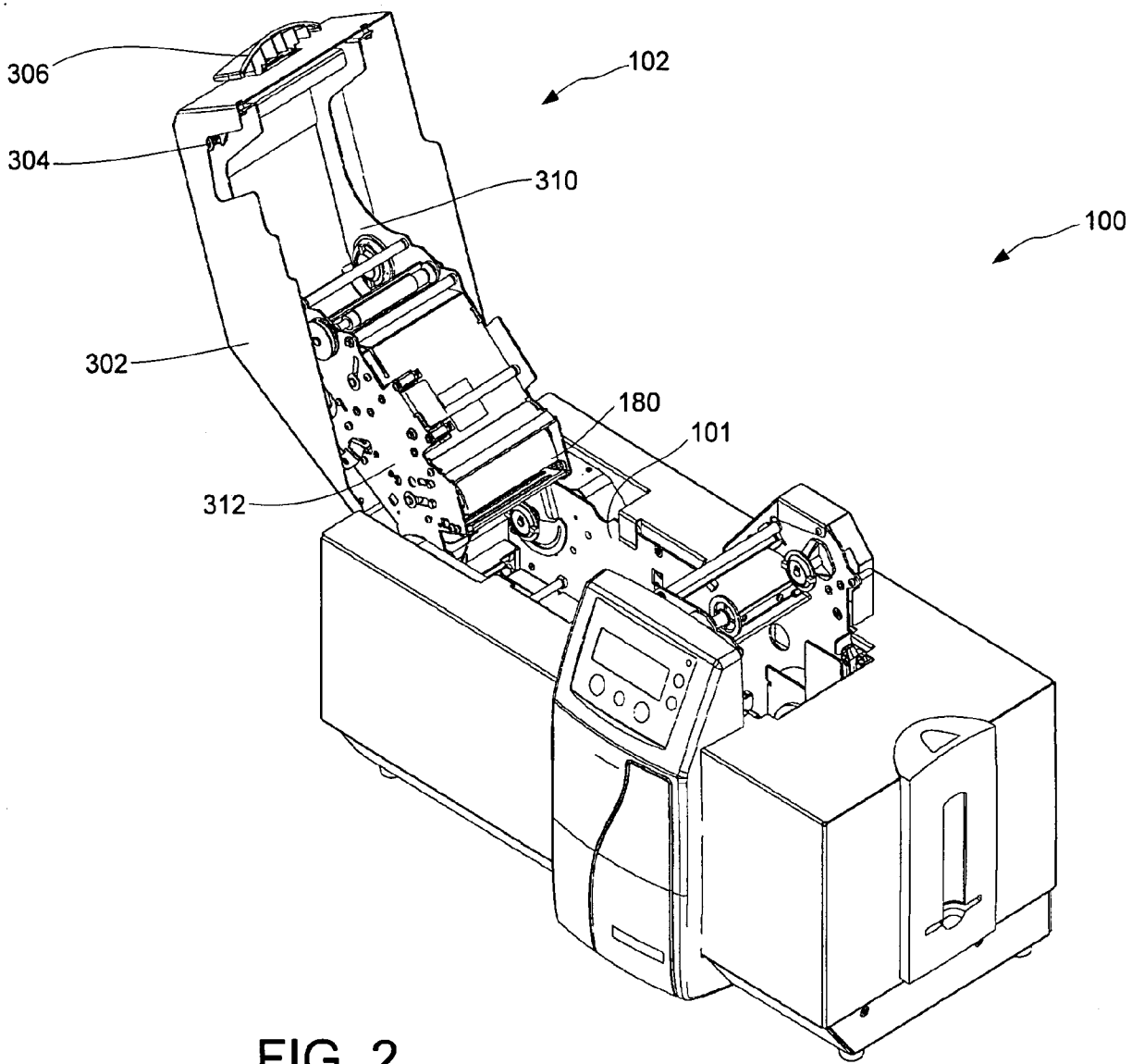

FIGS. 1 and 2 are perspective views of an exemplary identification card printer 100 having a swing arm assembly 102 respectively in closed and opened positions, in accordance with embodiments of the invention. In accordance with one embodiment of the invention, the printer 100 is a reverse-image printer that operates in a similar manner as that discussed in U.S. Pat. No. 6,261,012, which issued Jul. 17, 2002 and is assigned to Fargo Electronics, Inc. of Eden Prairie, Minn. However, as will be clear to those skilled in the art, while some aspects of the present invention relate specifically to reverse-image printers, others can be useful in both reverse-image printers and printers that print images directly to cards using thermal printheads, inkjet printheads, and other types of conventional printing mechanisms.

Figure 3:
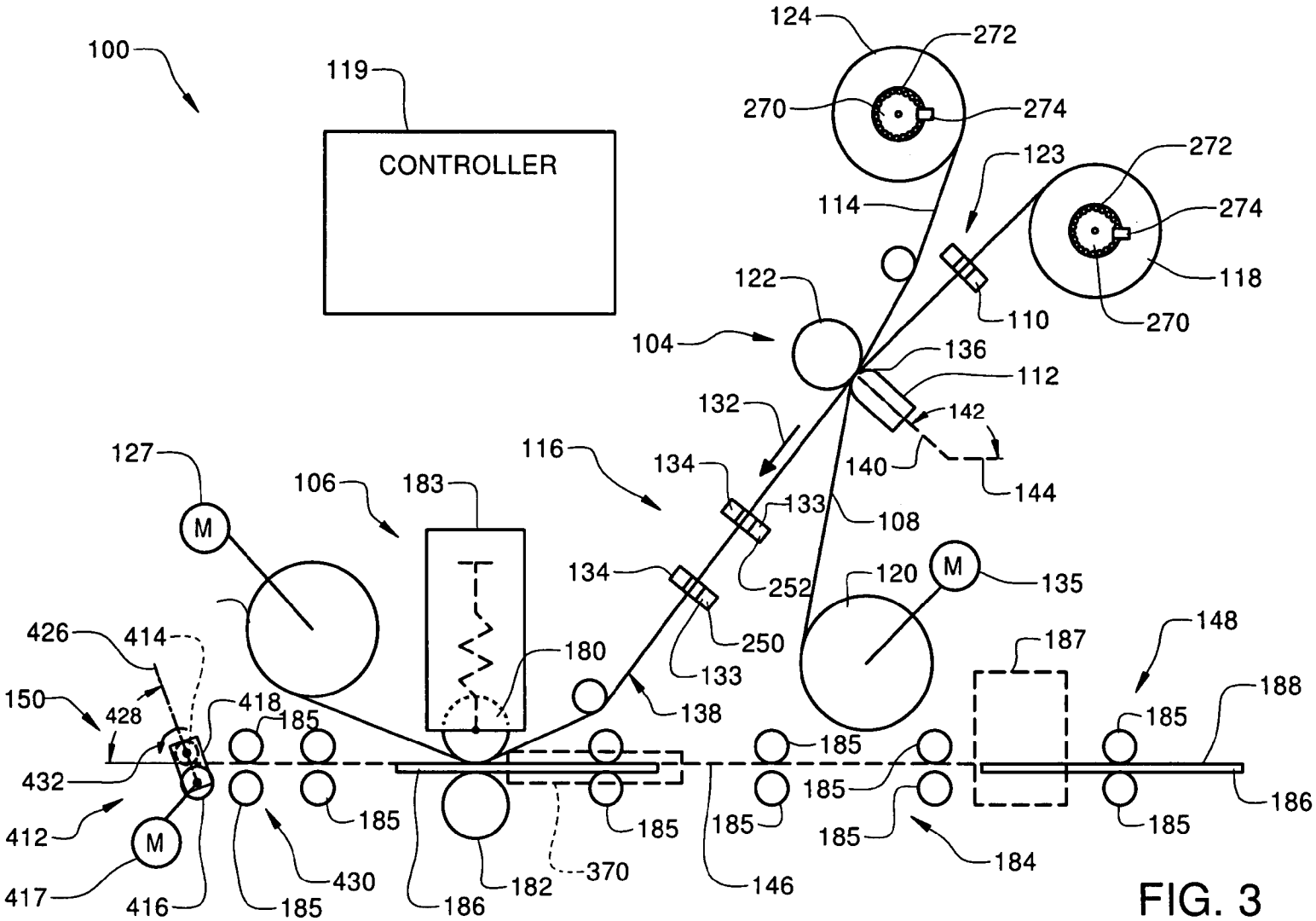
FIG. 3 is a schematic diagram of an identification card printer in accordance with embodiments of the invention.
Figure 4:
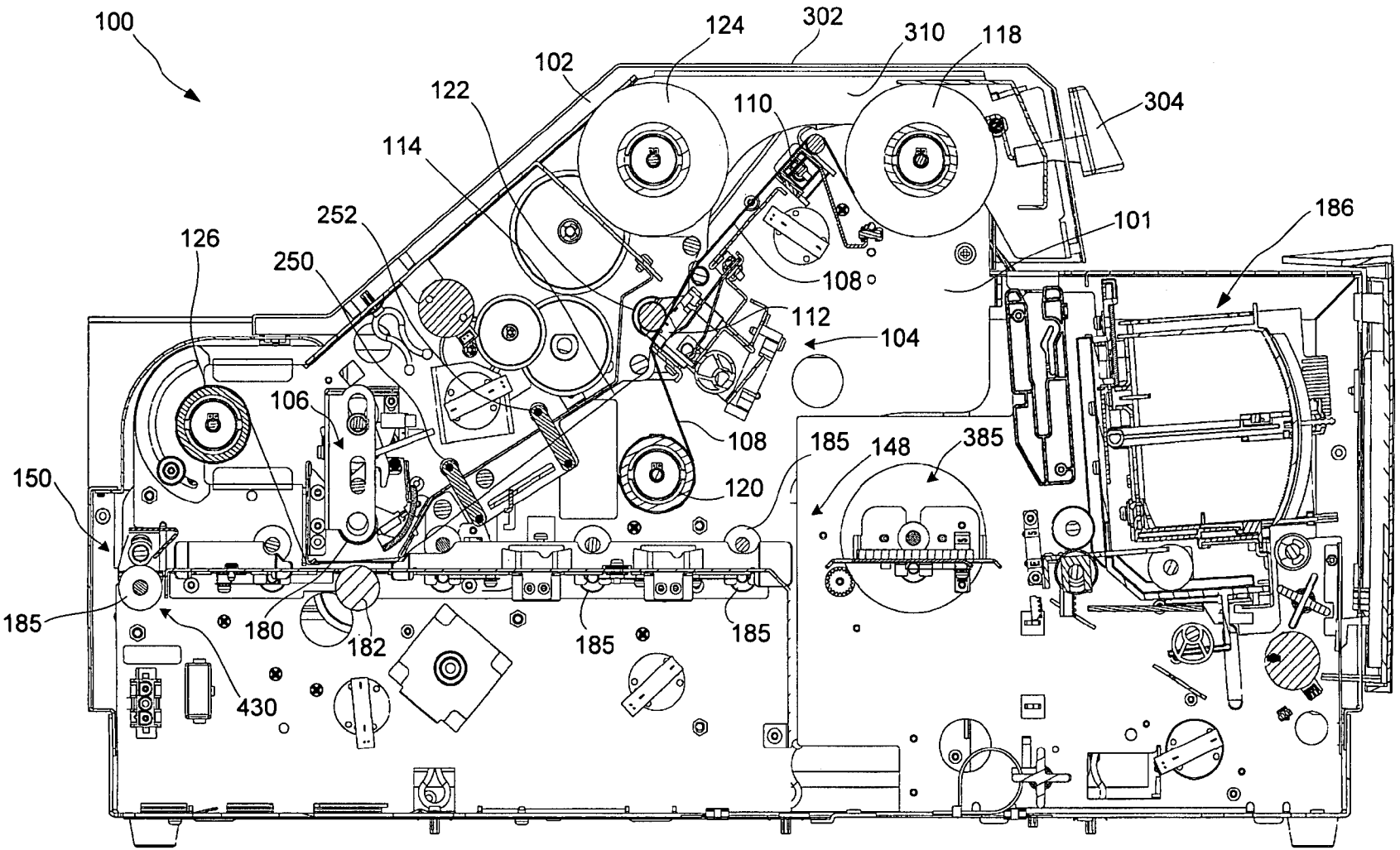
FIGS. 4 and 5 are side views of the printer shown in FIGS. 1 and 2 with a side wall of the printer frame removed, portions in cross-section, and the swing arm assembly respectively in the closed and opened positions.
Figure 5:
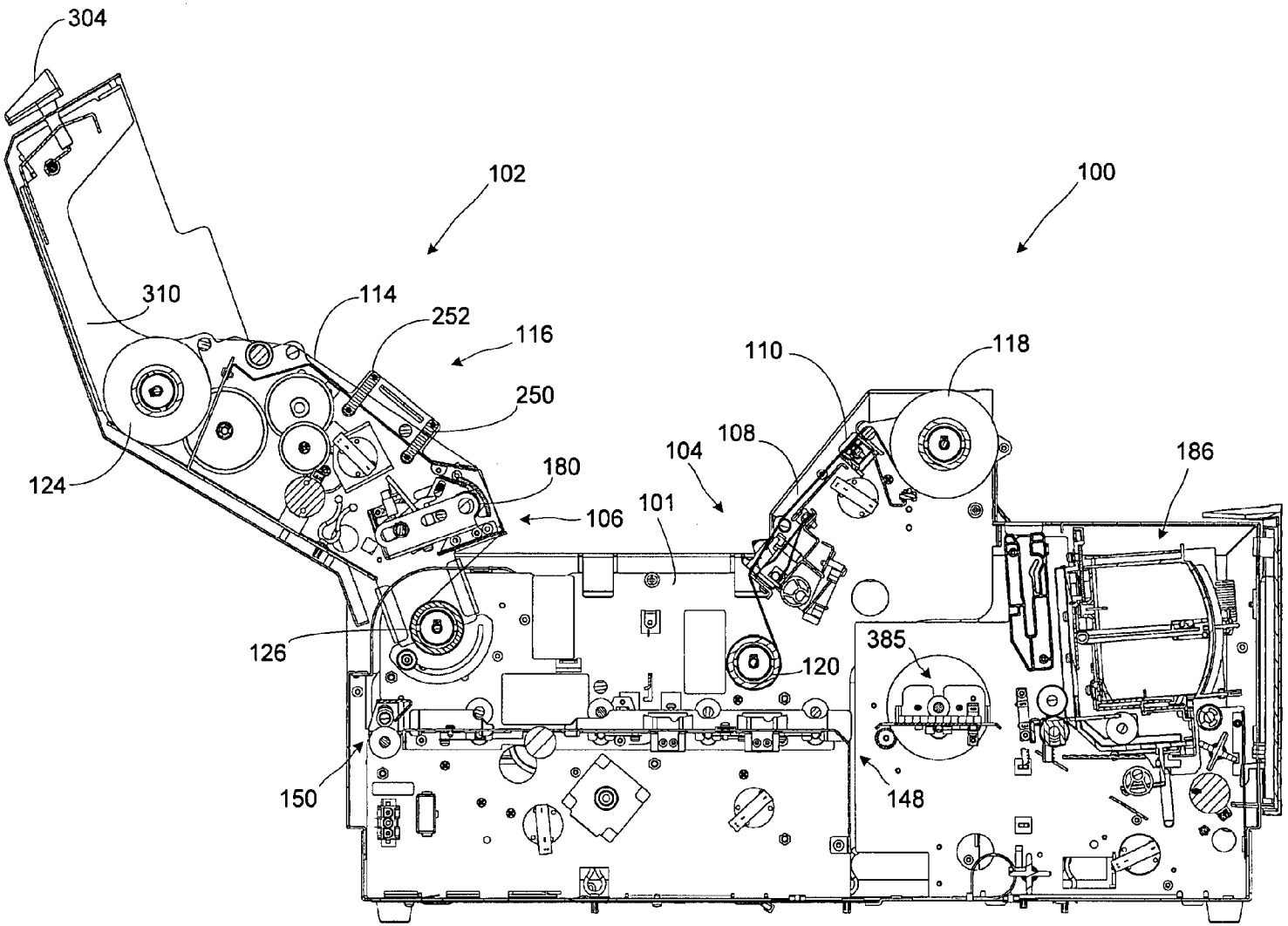

FIG. 3 is a schematic diagram illustrating various components of the printer 100, and FIGS. 4 and 5 are side views of the printer shown in FIGS. 1 and 2 with a side wall 101 of the printer frame removed, portions in cross-section, and the swing arm assembly 102 respectively in the closed and opened positions. Several components of the printer 100, such as communication and electrical connections between the various components, drive belts, card substrate stacks, and other components of printer 100 are not shown in order to simplify the illustrations. Similarly labeled elements in the figures correspond to the same or a similar element.

In general, printer 100 includes a printing section 104 and an image transfer section 106. The printing section 104 includes a supply of thermal print ribbon 108, a print ribbon sensor 110, a printhead 112, a supply of transfer film or ribbon 114, and at least one transfer film sensor 116. A controller 119 (FIG. 3) generally controls the components of printer 100 to perform various operations including printing, image transfer, ribbon tension calibration, sensor calibration, and other operations.

The print ribbon supply 108 is stored on supply and take-up spools 118 and 120, respectfully, and the ribbon 108 extends between the printhead 112 and a print platen 122. The ribbon sensor 110 can be a slotted optical sensor that includes an emitter and receiver pair 123, or other suitable sensor. The ribbon sensor 110 is configured to detect different color frames or panels along the length of the print ribbon 108. The frames or panels repeat in a sequence or group consisting of a yellow, magenta, and cyan panels. In addition, a black resin frame or panel can be provided in the sequence of the color panels, if desired. As will be discussed below in greater detail, embodiments of the invention relate to automatically setting the tension in the print ribbon 108 and/or transfer ribbon 114.

The transfer ribbon 114 is stored on supply and take-up spools 124 and 126, respectively, and extends between the print ribbon 108 and the print platen 122. The transfer ribbon 114 includes substantially clear or transparent panels 130 that are separated by a relatively opaque transition mark 131, as shown in the simplified top views of FIGS. 6 and 7. The transfer film sensor 116 (e.g., a slotted optical sensor) detects the transition marks 131 for the printer controller 119, which uses the sensor 116 to control the feeding of the transfer ribbon 114 in both a upstream direction and a downstream or feeding direction (feeding direction indicated by arrow 132) through the control of a bi-directional motor 127 (FIG. 3) in order to align the desired panel 130 with the printhead 112. The sensor 116 preferably includes an emitter 133 and a receiver 134 that are positioned on opposite sides of the transfer film 114 and are configured to detect the transitions 131 separating the panels 130. As will be discussed below in greater detail, embodiments of the present invention relate to the calibration of the sensor 116 and the positioning of the sensor and its components relative to other components of the printer 100.

The printer controller 119 generally controls the operation of printer 100 including the feeding of the print ribbon 108 through control of a motor 135 (FIG. 3). The alignment of the ribbon 108 and the printhead 112 is performed based on a signal from the ribbon sensor 110. Likewise, the controller 119 controls the feeding of the transfer ribbon 114 relative to the printhead 112 and other components of the printer 100 using the sensor 116.

Controller 119, is preferably formed on a single printed circuit board, and includes the control electronics for controlling the printing section 104 and the image transfer section 106 of printer 100. This is an improvement over prior art printer designs that utilize separate printer controllers and image transfer controllers formed on separate circuit boards. Such separation of the controllers leads to card processing problems due to miscommunications therebetween. Furthermore, the dual controller design requires additional components, which increases costs and the likelihood of a component failure.

The printhead 112 is preferably a thermal printhead, which operates with the print ribbon 108 to print an image to a panel 130 of the transfer ribbon 114 using heated print elements 136. Alternatively, printhead 112 can also be an ink jet printhead that uses ink to print an image to the panel 130 of the transfer ribbon 114 rather than the print ribbon 108.

In accordance with one embodiment of the invention, printhead 112 is configured to print upward onto a bottom surface 138 of individual transfer panels 130. The printhead 112 is preferably aligned, as indicated by dashed line 140 (FIG. 3), such that it is at an obtuse angle 142 relative to horizontal line 144, or to a card path 146 that is substantially horizontal from a card input 148 to a card output 150. Additional embodiments of the invention will be discussed below relating to the mounting of the printhead 112 in printer 100 and the maintaining of a substantially uniform pressure between the print elements 136 and the platen 122 during print operations.

The image transfer section 106 generally includes a heated transfer roller 180 and a transfer platen 182. The heated transfer roller 180 is preferably a 60 watt unit, which can be heated to the desired temperature much quicker than the lower power units used by printers of the prior art. The transfer ribbon 114 is fed between the transfer roller 180 and the platen 182. In accordance with one embodiment of the invention, the heated transfer roller 180 is positioned above the transfer platen 182. Either the transfer roller 180 or the transfer platen 182 can be moved relative to the other with a suitable lifting mechanism such as with a motorized lift 183, shown schematically in FIG. 3. One suitable motorized lift is described in U.S. patent application Ser. No. 10/418,730, filed Apr. 18, 2003, which is assigned to Fargo Electronics, Inc. of Eden Prairie, Minn., and is incorporated herein by reference in its entirety.

During a printing operation, the controller 119 controls the position of the panels of the print ribbon 108 and the panels 130 of the transfer ribbon 114 based upon signals from the print ribbon sensor 110 and the transfer ribbon sensor 116. The print elements 136 of the printhead 112 heat the print ribbon 108 to cause dye to transfer to the transfer ribbon panel 130 in accordance with known methods. For a color image, multiple passes over the same transfer ribbon panel 130 are made by printhead 112, each with a different color panel of the thermal print ribbon 108. Once the desired image has been printed to the transfer ribbon panel 130, the transfer ribbon panel 130 is moved to the image transfer section 106 (FIG. 3).

A card feeding mechanism 184 comprising feeding and guide rollers 185 that can be formed in pinch roller pairs, preferably delivers individual cards 186 through the printer 100. In general, the card feeding mechanism 184 feeds the individual cards 186 through the card input 148 and between the heated transfer roller 180 and the transfer platen 182, as illustrated in FIG. 3. In accordance with one embodiment of the invention, the card feeding mechanism 184 initially feeds the card 186 through a card cleaner 187, which cleans at least a print surface 188 of the card 186, to which an image is to be transferred, prior to delivery of the card to the heated transfer roller 180.

The transfer ribbon panel 130 containing the image to be transferred to the surface 188 of the card 186 is positioned between the surface 188 and the heated transfer roller 180. The image on the panel 130 adheres to the surface 188 through the application of heat and pressure by the transfer roller 180 under the support of the transfer platen 182. A suitable peel-off mechanism (not shown) can be positioned downstream of the heated transfer roller 180 and used to assist in the peeling of transfer ribbon 114 from the surface 188 while the image remains on the surface 188 to complete the printing of the image to the card 186. The printed card 186 can then be fed by the card feeding mechanism 184 through the output 150 for collection in a hopper or for feeding to a laminating module or other card processing component for additional processing.

Printhead Mounting

Figure 8:
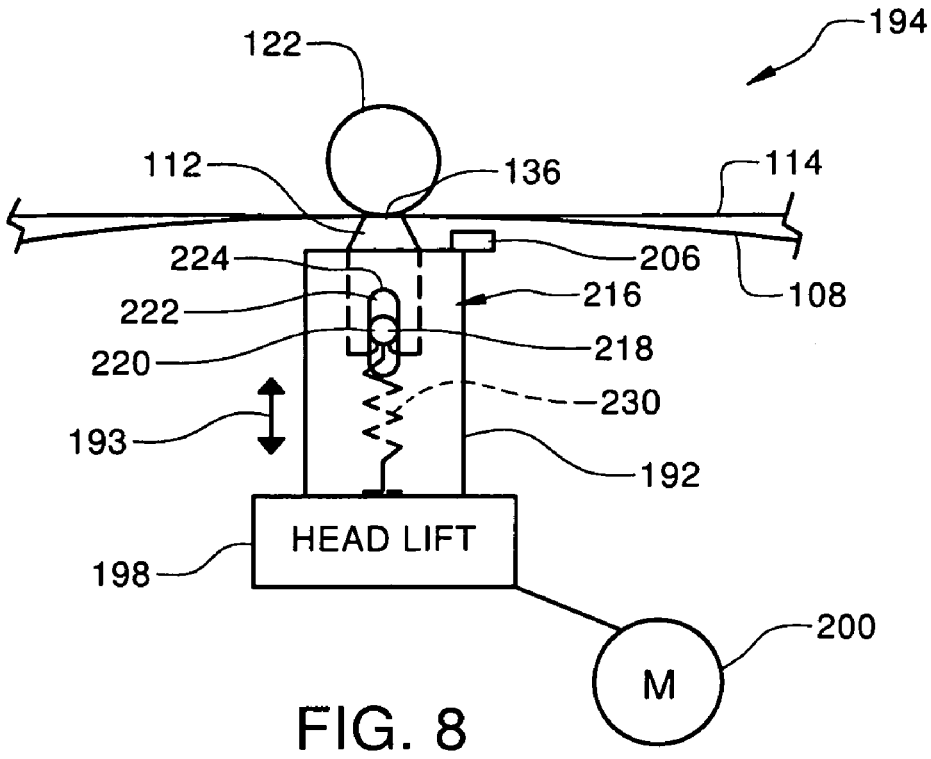
FIGS. 8 and 9 are schematic illustrations of a printhead mounting in accordance with embodiments of the invention.
Figure 9:
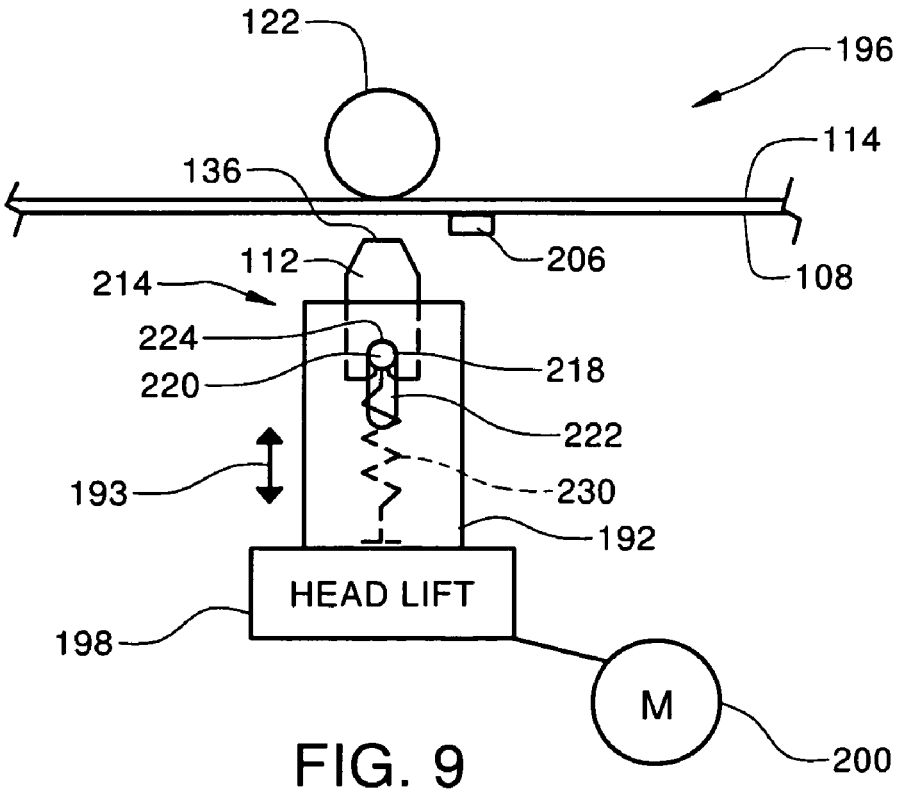

One embodiment of the invention includes a moveable printhead mounting 190, the general embodiments of which are shown in the schematic illustrations of FIGS. 8 and 9 and more specific embodiments are shown, which provide magnified views of the printing section 104 of the printer shown in FIG. 4. The mounting 190 facilitates loading and unloading of the print and transfer ribbons 108 and 114 and more accurate printing of images onto the transfer ribbon panels 130.

Figure 10:
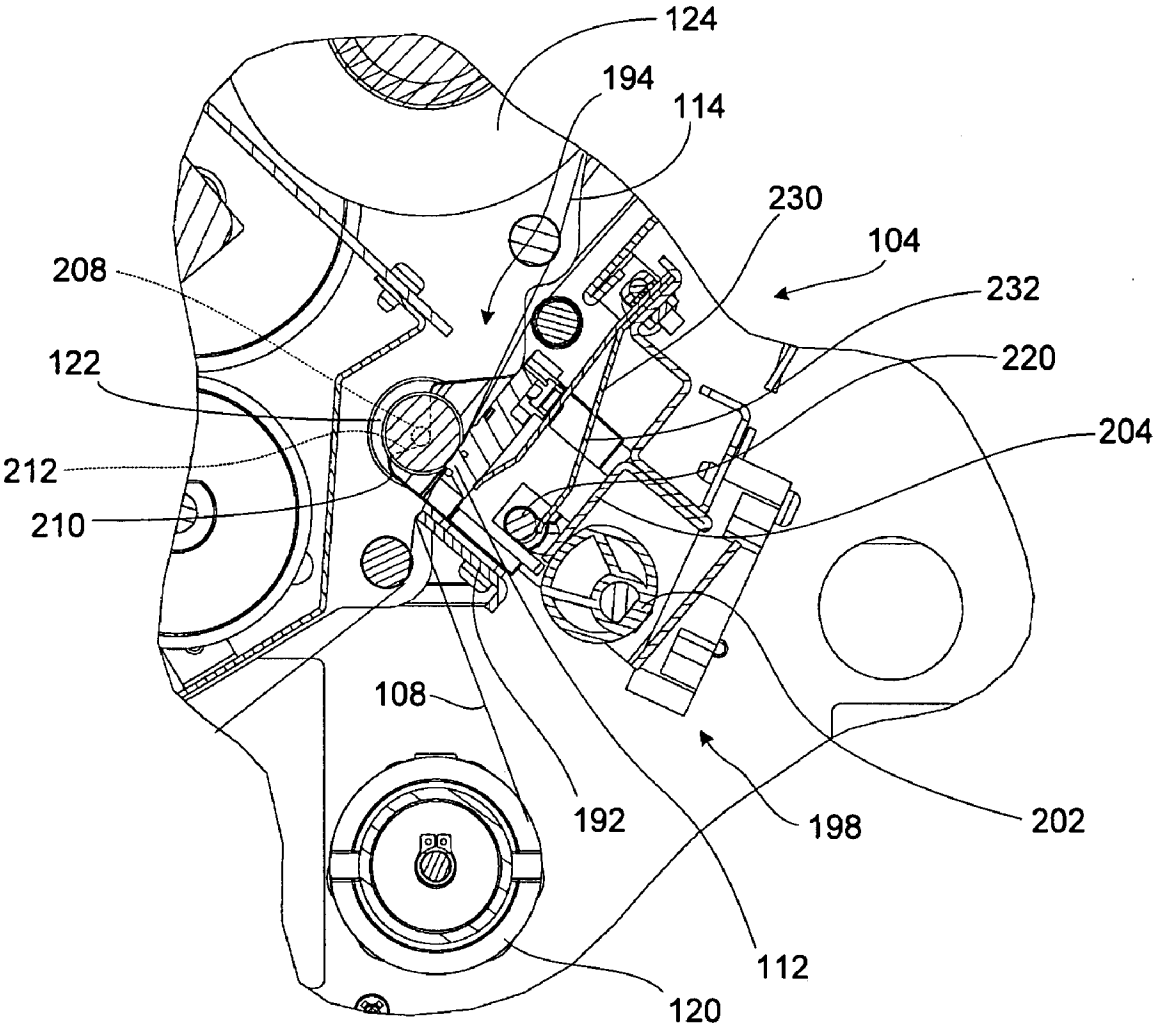
FIGS. 10 and 11 are magnified views of a printing section of the printer shown in FIG. 4 illustrating different positions for the printhead.
Figure 11:
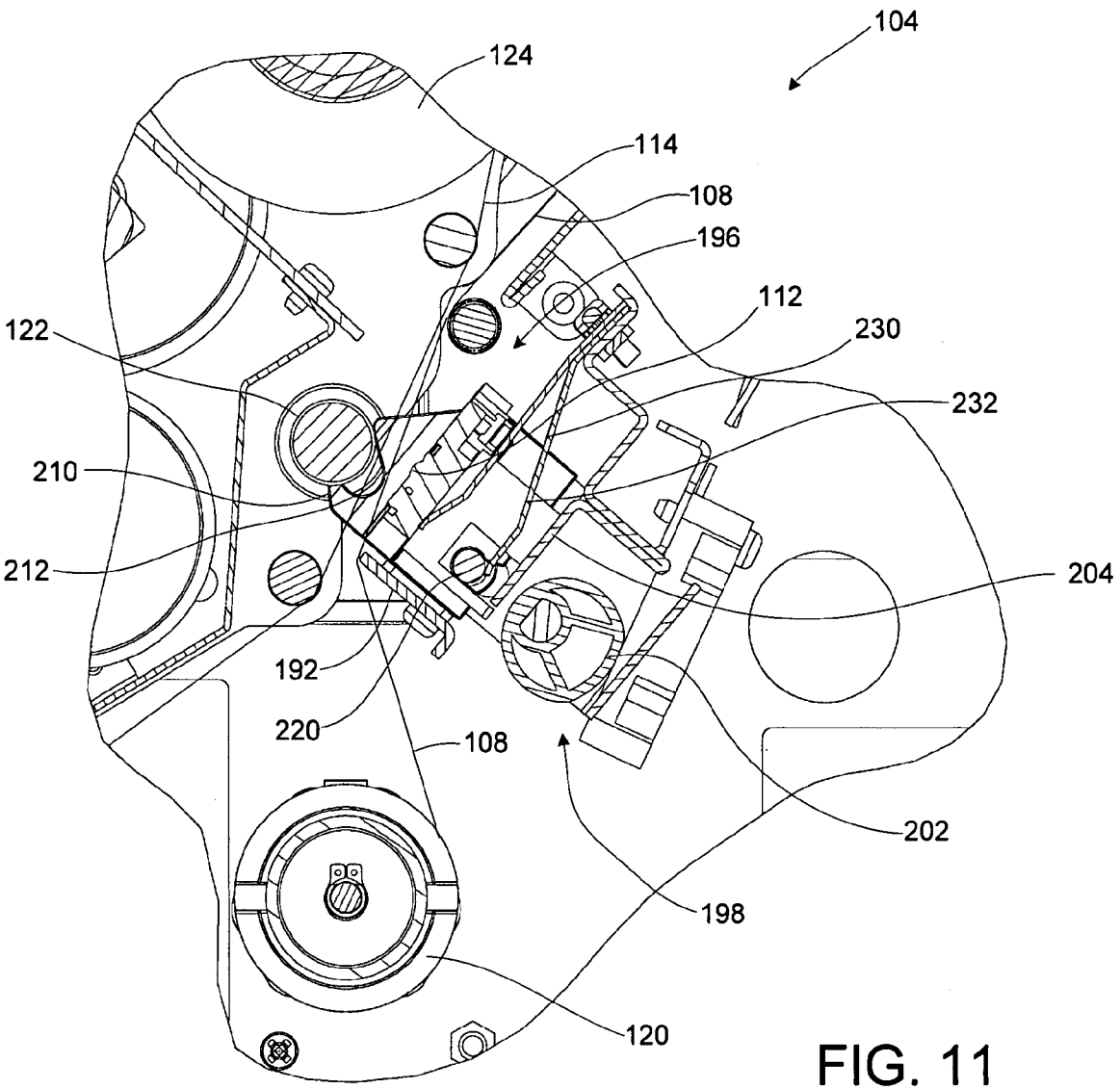

The mounting 190 for the printhead 112 includes a first support 192, such as a bracket, to which the printhead 112 is moveably mounted. The first support is moveable, as indicated by arrow 193 (FIGS. 8 and 9) between a print position 194, shown in FIGS. 8 and 10, and a withdrawn position 196, shown in FIGS. 9 and 11. Print operations can occur when the first support 192 is in the print position 194, in which a substantially uniform pressure is applied between the printhead 112 and the print platen 122. When in the print position 194, the print or resistive heating elements 136 of the printhead 112 squeeze the print ribbon 108 and the transfer ribbon 114 against the platen 122. Removal and installation of the print and transfer ribbons 108 and 114 can occur when the printhead 112 is in the withdrawn position 196, in which the first support 192 and the printhead 112 are displaced from the platen 122.

In accordance with one embodiment of the invention, the movement of the first support 192 between the print and withdrawn positions 194 and 196 is provided by a head lift 198, which is preferably driven by a motor 200 (FIGS. 8 and 9) under control of controller 119. The head lift 198 can include a rotatable cam member 202 that engages a cam follower 204 and drives the first support 192 toward the print position 194 through the controlled rotation of the cam member 202. The first support is preferably guided between the print and withdrawn positions 194 and 196 by tab members extending through slots in the side walls 101 of the printer frame, or other suitable manner.

The print position 194 for the first support 192 is preferably defined by a first support stop 206, shown generally in FIGS. 8 and 9, that engages the first support 192 to thereby limit the minimum spacing between the first support 192 and the print platen 122. In accordance with one embodiment of the invention, the first support stop 206 includes an axle 208 of the platen 122 and the first support 192 includes an axle receiver 210 that engages the axle 208 when in the print position 194, to thereby limit the minimum spacing between the first support 192 and the print platen 122. The axle receiver 210 preferably includes a notch 212 (FIG. 11) configured to receive the axle 208. In accordance with one embodiment of the invention, the first support 192 includes a pair of axle receivers 210 that engage the axle 208 of the print platen 122 adjacent each of the side walls 101 of the printer frame. Those skilled in the art understand that many different types of first support stops 206 can be used to provide the desired limitation to the minimal spacing between the first support 192 and the print platen 122.

The printhead 112 is preferably moveably mounted to the first support 192 to allow it to move relative to the first support 192 between a forward position 214 (FIGS. 9 and 11) in which the printhead 112 is biased when the first support 192 is in the withdrawn position 196, and a floating position 216 (FIGS. 8 and 10) to which the printhead 112 moves when the first support 192 is in the print position 194 and the printhead 112 engages the platen 122. In accordance with one embodiment of the invention, printhead 112 is mounted to a second support 218, which in turn is moveably mounted to the first support for movement between the forward and withdrawn positions 214 and 216.

One embodiment of the second support 218 includes a cross member 220 (e.g., a rod) that extends through slots 222 formed in side walls 223 of the first support 192 and preferably through the side walls 101 of the printer frame for additional support. The cross member 220 can slide within the slots 222 between the forward and withdrawn positions 214 and 216. The forward position 214 can be defined by a stop member 224 that limits the movement of the printhead 112 and second support 218 toward the platen 122. In accordance with one embodiment of the invention, the stop member 224 is formed by the end 226 of the slots 222 that is located toward the print platen 122 that limit the movement of the second support 218 toward the platen 122 relative to the first support 192, as shown in FIG. 9.

A biasing mechanism 230 operates to apply a biasing force to the printhead 112 to thereby direct the printhead 112 toward the forward position 214. In accordance with one embodiment of the invention, the biasing mechanism 230 includes at least one, but preferably two spring members 232 each positioned at an end of the printhead 112 or the second support 218, such as leaf springs (FIGS. 10 and 11), elastic bands, or other suitable biasing mechanisms. When the first support 192 is in the withdrawn position 196, the biasing mechanism 230 directs the printhead 112 and/or the second support 218 to the forward position 214 as limited by the stop member 224, as shown in FIG. 9. As the first support 192 is moved into the print position 194, shown in FIGS. 8 and 10, pressure is applied to the printhead 112 by the print platen 122, which overcomes the biasing force produced by the biasing component 230 and causes the printhead and/or the second support 218 to move into the floating position 216. When in the floating position 216, the biasing mechanism 230 applies a substantially uniform pressure to the print and transfer ribbons 108 and 114 against the platen 122 by the print elements 136 of the printhead 112. The uniform pressure improves print image quality and color-to-color registration.

Ribbon Sensor Calibration

Referring again to FIGS. 6 and 7, which are simplified top views of the transfer film sensor 116 adjacent the transfer film 114, in accordance with embodiments of the invention. As mentioned above, the transfer film sensor 116 preferably includes at least one emitter 133 and receiver 134 pair (FIG. 3) which operate to detect transitions 131 that are between the individual panels 130 of transfer film 114 for use by controller 119 to control the feeding of the transfer film 114 relative to the printhead 112 and the heated transfer roller 180. The transition 131 is generally detected by the sensor 116 when the transition 131 blocks the receiver 134 from detecting at least a threshold amount of a light signal that is transmitted by the emitter 133 as the transition 131 passes between the emitter 133 and the receiver 134.

It is desirable to set the intensity of the light signal transmitted by the emitter 133 to a level that provides accurate detection of the transitions 131 of the transfer ribbon 114. If the light signal has an intensity that is set too high, the light signal can bleed around, and possibly pass through, the transition 131 thereby preventing the detection of the transition. On the other hand, if the intensity of the light signal is set too low, the receiver 134 could fail to detect the light signal even when a panel 130 of the transfer film 114 is positioned between the emitter 133 and the receiver 134. Therefore, proper calibration of the transfer film sensor 116 is essential for accurate detection of the transition 131.

Figure 12:
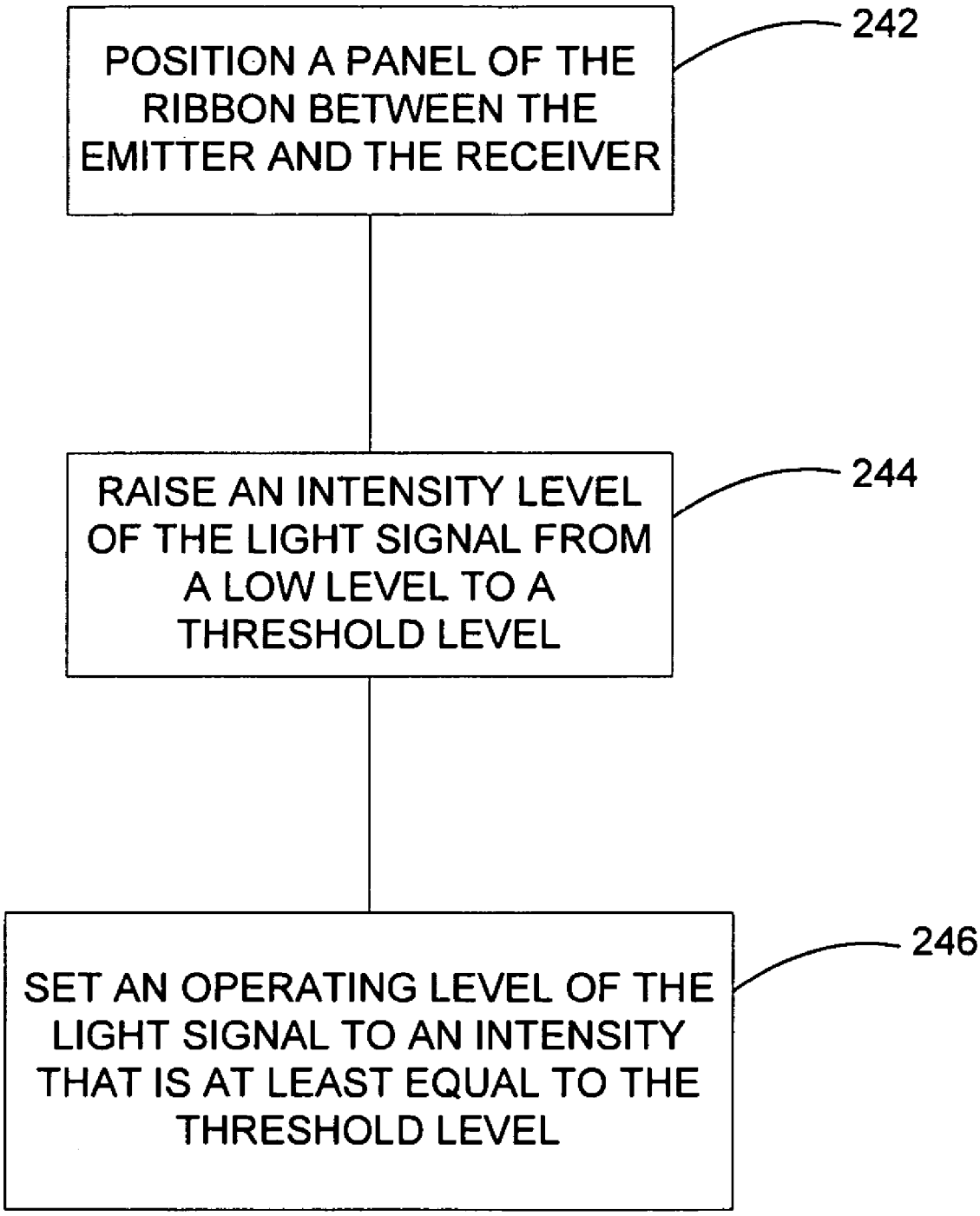
FIG. 12 is a flowchart illustrating a method of calibrating a ribbon sensor in accordance with embodiments of the invention.

In accordance with one embodiment of the invention, the transfer ribbon sensor 116 is calibrated for transition detection either at the factory or during an initial start-up routine for printer 100. The calibration routine can be performed either manually or automatically by the controller 119 of printer 100, driver software, or a card manufacturing application running on an associated computer, for example. One embodiment of the calibration routine is illustrated in the flowchart of FIG. 12. Initially, at step 242, the transition 131 of the transfer ribbon 114 is positioned beyond transfer ribbon sensor 116 such one of the non-printed panels 130 of the ribbon 114 is positioned between the emitter 133 and the receiver 134 to allow the emitter 133 to transmit the light signal through the panel 130. At step 244, the intensity of the light signal emitted by the emitter 133 of the sensor 116 is raised to a threshold level, at which the receiver 134 of the sensor 116 begins to detect the light signal. The intensity of the light signal transmitted by the emitter 133 is then set to an operating level that is at least equal to the threshold level, at step 246. Preferably, the operating level is set slightly higher than the threshold level. Such calibration of the transfer ribbon sensor 116 ensures that the transitions 131 of the transfer ribbon 114 will be detectable by the sensor 116.

Ribbon Sensors

Accurate positioning of individual transfer ribbon panels 130 relative to printhead 112 and the heated transfer roller 180 generally requires that the transfer ribbon sensor 116 be positioned at least the length of one panel 130 away from the element it is to be aligned with. The transfer ribbon sensors of the prior art have been positioned upstream of printhead 112 relative to the feeding direction 132 (FIGS. 3, 6 and 7) of the transfer ribbon 114. As a result, the supply spool 124 of transfer ribbon 114 must extend more than the length of one panel 130 away from the printhead 112 to accommodate such a sensor. As a result, it becomes necessary to form the printer large enough to accommodate the position of the sensor.

Figure 6:
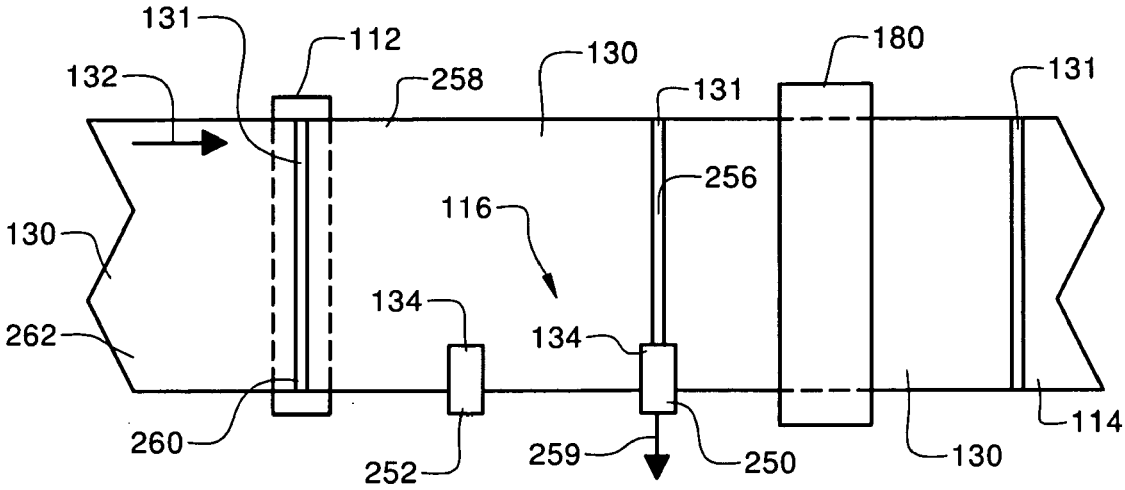
FIGS. 6 and 7 are simplified top views of a transfer film sensor adjacent a transfer film, in accordance with embodiments of the invention.
Figure 7:
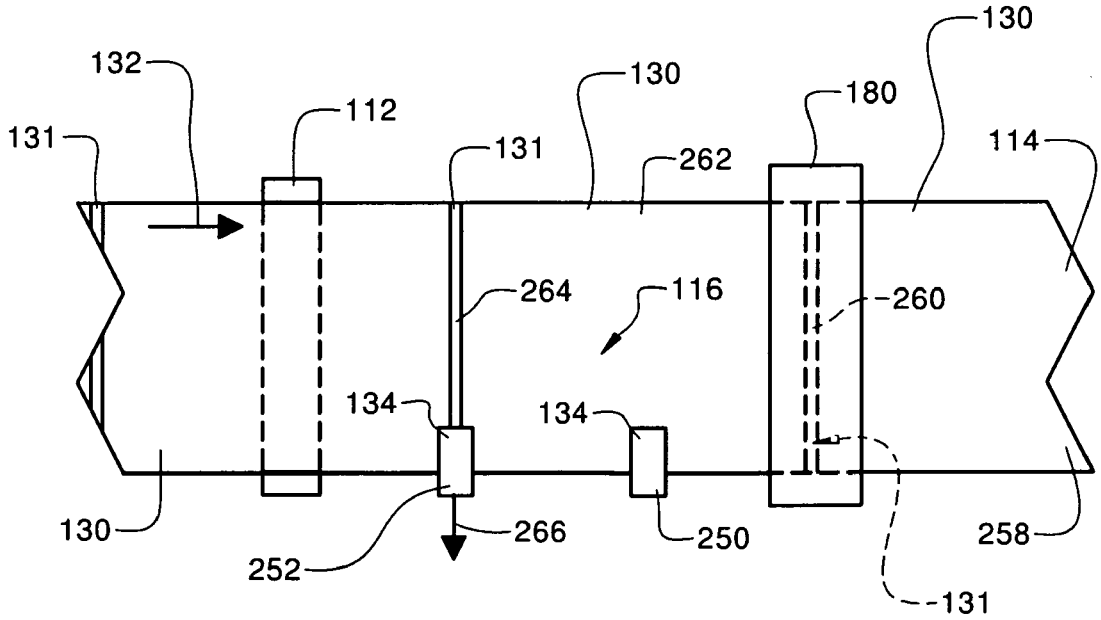

In accordance with one embodiment of the invention, the transfer ribbon sensor 116 includes first and second sensors 250 and 252 that are positioned downstream of the printhead 112 and upstream of the transfer roller 180, as shown in FIGS. 3, 6 and 7. The first sensor 250 is positioned downstream of the second sensor 252. The first and second sensors 250 and 252 are separated by a length that is less than a length of a transfer ribbon panel 130. Each of the first and second sensors 250 and 252 are preferably optical sensors that each include an emitter 133 and a receiver 134 that are positioned on opposite sides of the transfer ribbon 114 and are configured to detect the transitions 131 between individual panels 130 of the transfer ribbon 114 for the controller 119, as discussed above. The first and second sensors 250 and 252 are preferably calibrated as explained above to detect the transition 131.

The first ribbon sensor 250 is preferably a print sensor that is used during printing operations to detect the position of a leading transition 256 downstream panel 258 relative to the printhead 112 and the feeding direction 132, as illustrated in FIG. 6. In accordance with one embodiment of the invention, the first sensor 250 is positioned such that the detection of the leading transition 256 of the downstream panel 258 indicated by an output signal 259 from the receiver 184 indicates that the position of a trailing transition 260 of the downstream panel 258 or the leading transition 260 of the upstream panel 262 is aligned with printhead 112. Accordingly, queuing the downstream panel 258 relative to the first sensor 250 queues the upstream panel 262 to the printhead 112. As a result, the printhead 112 is prepared to print the desired image to either the upstream panel 262 or the downstream panel 258. Following the printing of the desired image onto the selected transfer panel 130, preferably the upstream panel 262, the printed transfer panel is fed forward to the image transfer section 106.

Second sensor 252 is preferably used to queue the printed panel 130 with the heated transfer roller 180 of the image transfer section 106 of the printer 100. For this example, the panel 262 will be the printed panel. In general, the printed transfer panel 262 is fed forward until the second sensor 252 detects the trailing transition 264 of the printed transfer panel 262 as indicated by an output signal 266, as shown in FIG. 7. Preferably, the second sensor 252 detects the trailing edge of the trailing transition 264 to avoid interference by the image printed on the panel 262. The second sensor 252 is preferably the length of one panel 130 away from the heated transfer roller 180. Accordingly, the printed panel 262 is positioned for image transfer to a properly positioned card 186 when the second sensor 252 detects the trailing transition 264 of the printed panel 262, as shown in FIG. 7.

Ribbon Tension Calibration

During printing and image transfer operations, printer controller 119 maintains accurate control of the feeding and positioning of the print and transfer ribbons 108 and 114 relative to the printhead 112, or the transfer ribbon 114 relative to the heated transfer roller 180, using sensors 110 and 116 and encoder wheels 270, such as those shown schematically in FIG. 3. The encoder wheels 270 have, for example, a plurality of angularly spaced apertures 272, that are used to detect rotation of the encoder wheel 270 using optical sensors 274 in accordance with conventional methods. The encoder wheels 270 are preferably configured such that their rotation directly corresponds to a rotation of the corresponding supply spools 118 and 124. As a result, the measure of the rotation of the encoder wheels 270 can be used to measure the rotation of the corresponding supply spools 118 and 124 and, hence, the amount of ribbon that is being fed or retrieved. For example, a count can be made of the passage of the apertures 272 of the encoder wheel 270, or the light blocking portions between the apertures 272, using the sensor 274, to maintain an account of the feeding of the ribbon in accordance with known methods.

Installation of the print and image transfer ribbons 108 and 114 requires that they be fed through and around several components of the printer 100, such as the sensors 110 and 116, the printhead 112, the platen 122, and other components. It is generally necessary to create slack in the ribbons to perform the installation. The slack in the ribbons 108 and 114 must be removed between their supply and take-up spools to complete their proper installation. Prior art methods require the user to manually roll the supply and/or take-up spools of the ribbon supplies to remove the slack. Unfortunately, problems can arise due to the setting of too much, or too little, tension in the ribbon which can adversely affect the performance of the printer.

One embodiment of the present invention provides automated tensioning of the print ribbon 108 and/or the image transfer ribbon 114. In general, following the installation of the ribbons 108 and 114 with the printhead 112 preferably in the withdrawn position 196, the printer controller 119 drives the corresponding take-up spool, such as take-up spool 120 for the print ribbon 108, or the take-up spool 126 for the transfer ribbon 114, until the encoder wheel 270 of the corresponding supply spool 118 or 124 registers rotation of the supply spool using the corresponding sensor 274. Once rotation of the supply spool is detected, the tension of the ribbon is properly set.

Swing Arm Assembly

Printer 100 includes a swing arm assembly 102, shown in FIGS. 1, 2, 4 and 5, to which several components of printer 100 are mounted. The swing arm assembly 102 is preferably covered by a cover 302 of housing 102, as shown in FIG. 1. The swing arm assembly 102 includes a closed position shown in FIGS. 1 and 4, and an open or raised position shown in FIGS. 2 and 5. The swing arm assembly 102 is maintained in the closed position by a suitable latching mechanism 304 that can be released by actuation of a handle 306. When the swing arm assembly 102 is in the raised position, the printhead 112 preferably automatically moves to the withdrawn position 196 and the operator can load the print and image transfer ribbons 108 and 114 into printer 100 as well as gain access to other components of printer 100.

The swing arm assembly 102 generally includes a swing frame having a pair of side walls 310 and 312, to which components of the swing arm assembly 102 are mounted, such as drive rollers, gears, ribbon guides, ribbon sensors, and other components. Additionally, the transfer ribbon supply spool 124 is mounted to the swing arm assembly 102, as shown in the side views of FIGS. 4 and 5 where the front side wall is removed.

Figure 13:
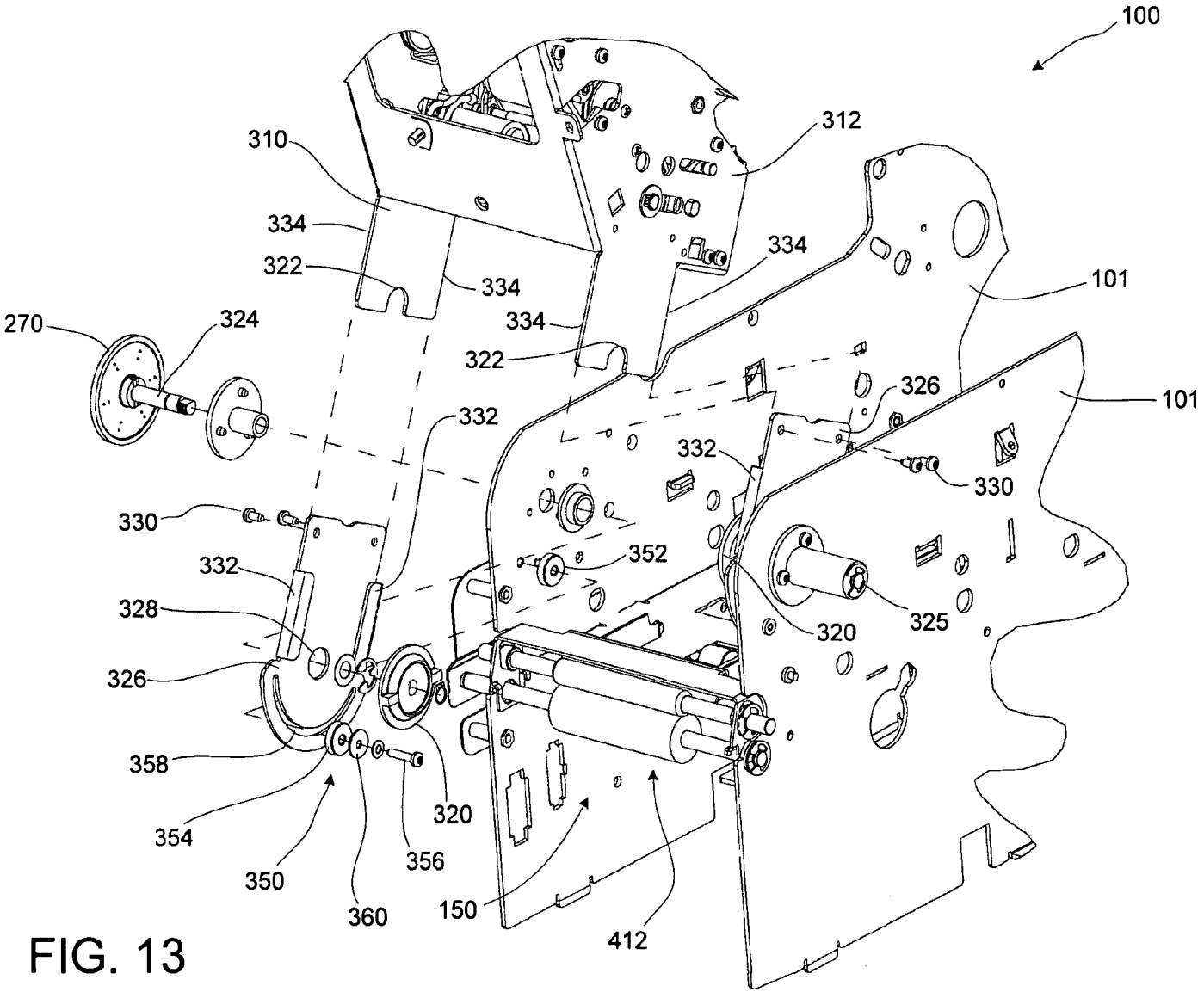
FIG. 13 is a partial exploded perspective view of a card output portion of the printer shown in FIG. 4, in accordance with embodiments of the invention.

In accordance with one embodiment of the invention, the swing frame of the swing arm assembly 102 is mounted between the side walls 101 of the printer frame, such that it rotates about an axis of rotation of the transfer ribbon take-up spool 126 as defined by a first ribbon roll support, such as the transfer ribbon hubs 320, shown in FIG. 13, which is a partial exploded perspective view of the printer 100 at the card output 150. This configuration simplifies the installation of the image transfer ribbon 114 by preventing the development of excessive slack or tension in the image transfer ribbon 114 by maintaining a constant relative position between the transfer ribbon supply spool 124 and the transfer ribbon take-up spool 126 during the closing of the swing arm assembly 102.

One embodiment of the swing arm assembly 102 includes a notch 322 in the side walls 310 and 312 that rest on the shafts 324 and 325 of the transfer ribbon take-up hubs 320 that are mounted to the side walls 101 of the printer frame. Brackets 326 include an aperture 328 through which the corresponding shaft 325 or 324 extends. Once the notches 322 of swing arm assembly side walls 310 and 312 are placed on the shafts 324 and 325, the brackets 326 are mounted to the side walls 310 and 312 with screws 330 or other suitable fasteners. The brackets 326 can also include one or more slot features 332 that receive edges 334 of the side walls 310 and 312 of swing arm assembly 102 to assist in the proper mounting of the side walls 310 and 312 of the swing arm assembly 102 to the brackets 326.

Swing Arm Brake

Another embodiment of the invention is directed to a swing arm brake 350 that resists rotation of the swing arm assembly 102 to assist in maintaining the swing arm assembly 102 in the opened position, and to prevent the swing arm assembly 102 from crashing to the closed position. Embodiments of the brake 350 are shown in the exploded perspective view of FIG. 13, and in the simplified partial front assembled view of the brake 350 of FIG. 14. The brake 350 includes one or more disc members, such as disc members 352 and 354, that are mounted to the sides of at least one of the brackets 326 of the swing arm assembly 102. A screw 356, or other suitable member, extends through a side wall 101 of the printer frame and a slot 358 in the bracket 326. The screw 356 also extends through the disc member 352 that is positioned between the side wall 312 and the bracket 326, and the disc member 354 that is positioned between the bracket 326. Washers 360 and nuts 362 (FIG. 14) can be used to complete the installation of the brake 350.

Figure 14:
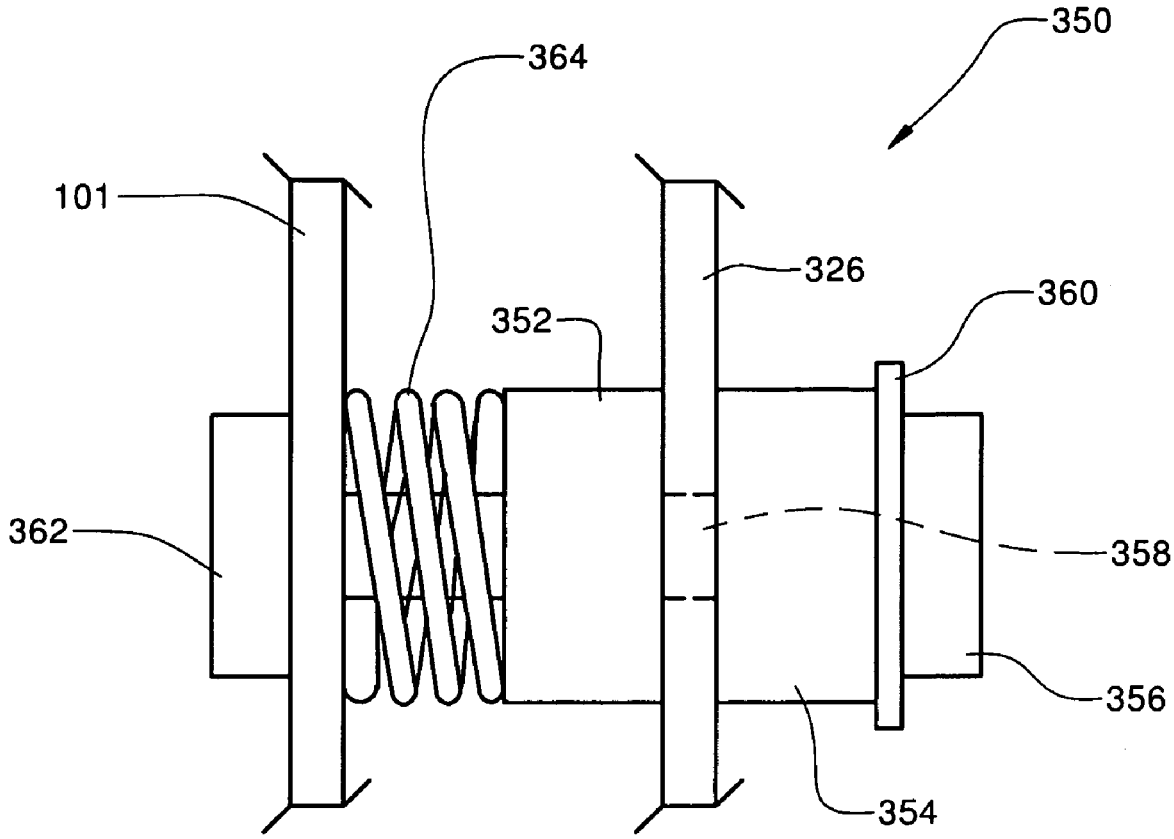
FIG. 14 is a simplified partial front assembled view of a swing arm brake, in accordance with embodiments of the invention.

The material forming the disc members 352 and 354 is selected to provide the desired frictional resistance against the bracket 326 to resist rotation of the swing arm assembly 102, and is preferably plastic (such as Delrin®), rubber or other suitable material. The frictional resistance can be adjusted by tightening or loosening the screw 356 to respectively increase or decrease the pressure applied to the bracket 326 by members 352 and 354. Alternatively, a spring 364 can be positioned between the disc member 352 and the side wall 101, for example, to produce the desired frictional resistance to the rotation of the bracket 326 and the swing arm assembly 102, as shown in FIG. 14.

Card Guide

Figure 15:
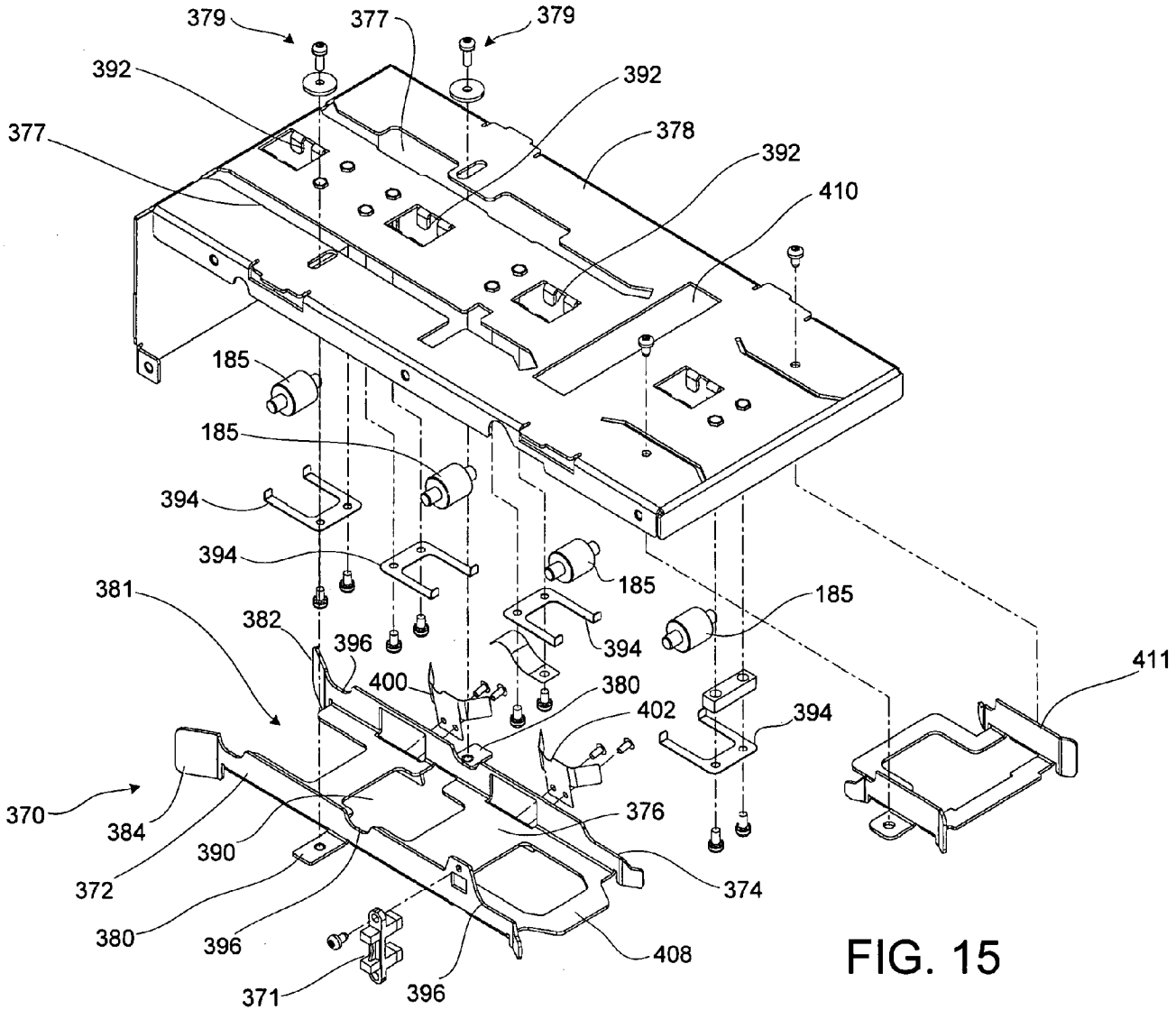
FIGS. 15 and 16 respectively are exploded and assembled perspective views of a card guide, in accordance with embodiments of the invention.
Figure 16:
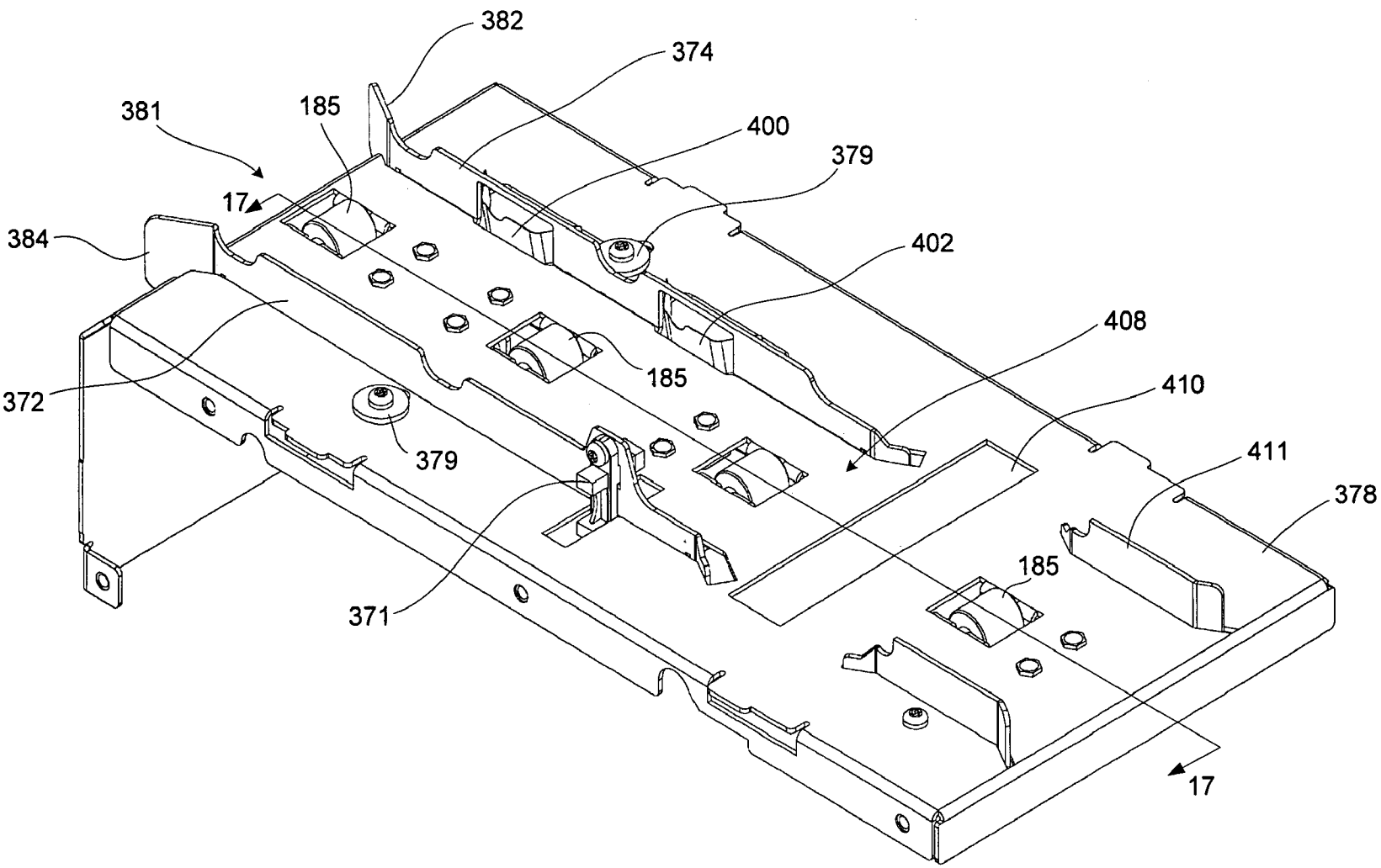
Figure 17:
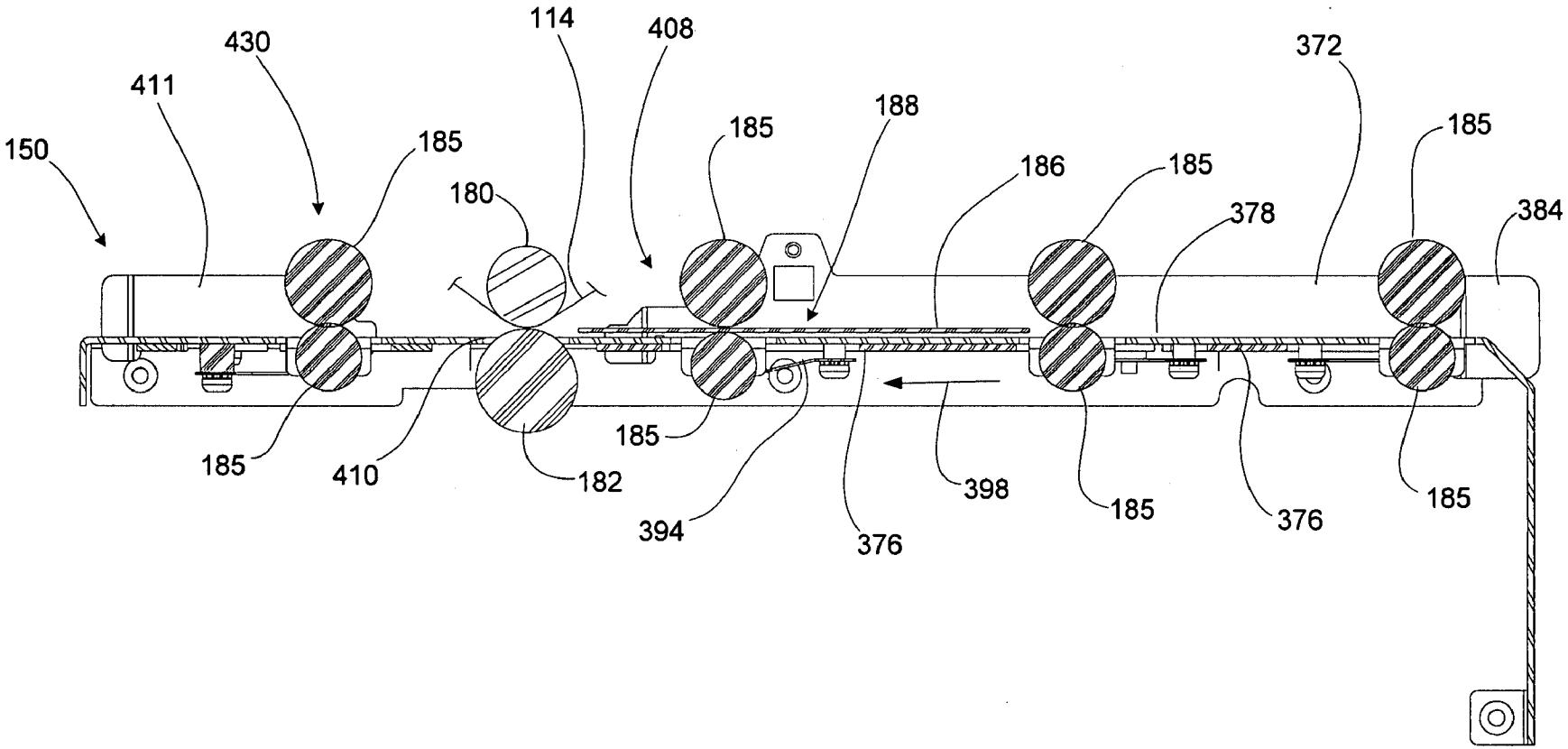
FIG. 17 is a cross-sectional view of a card guide shown in FIG. 16 taken along line 17-17 with the addition of top guide rollers and a card.

It is critical that the card substrates 186 that are fed from the input 148 are properly aligned with the printed transfer panel 130 during the image transfer operation to ensure that the image is properly positioned on the surface 188 of the card 186. One embodiment of the present invention is directed to a card guide 370, shown in the exploded and assembled perspective views of FIGS. 15 and 16, respectively. FIG. 17 is a cross-sectional view of the card guide 370 that is generally taken along line 17-17 of FIG. 16, but with the addition of top guide rollers 185 of the card transfer mechanism 184 and a card 186.

The card guide 370 is generally positioned in the card path 146 and operates to align the card 186 horizontally with the printed image at the image transfer section 106, as shown in FIGS. 3-5. One or more card sensors 371 (FIGS. 15 and 16), such as optical sensors, are generally used to detect a leading edge of the card 186 such that the controller 119 can align the card longitudinally with the printed image.

The card guide 370 includes side guide members 372 and 374 that are joined together by a base member 376 to prevent relative movement therebetween. As a result, the side guide members 372 and 374 are fixed in a predetermined position relative to each other and are spaced to receive cards 186 having a standardized card width. The card guide 370 is installed in printer 100 such that the side guide members 372 and 374 extend through slots 377 in a bottom plate 378 that forms a portion of the printer or base frame of the printer 100.

The position of the card guide 370 is preferably adjustable relative to the bottom plate 378 in accordance with the size of the slots 377 and is fixed in place using suitable fasteners 379 that extend through tabs 380 of the card guide 370. A receiving end 381 of the card guide 370 can include flared tabs 382 and 384 that assist in the receiving of the transported cards 186 between the side guide members 372 and 374. The receiving end 380 is positioned adjacent the input 148 of printer 100 to receive cards 186 fed directly from, for example, a card flipper 385 or a card hopper 386 shown in FIGS. 4 and 5, a user of printer 100, or from another card processing device.

Portions of lower rollers 185 extend through the bottom plate 378 and openings 390 in the base member 376 of the card guide 370. The rollers 185 are supported within notches 392 by members 394. Notches 396 formed along the top edge of the side guide members 372 and 374 receive the shafts of upper rollers 185 to form pinch roller pairs along the card path 146. Preferably the top rollers 185 are motorized to drive the card along the print path 146.

As the card 186 is fed through the card guide 370 from the receiving end 380 in the direction indicated by arrow 398 (FIG. 17) the card engages flexible card bumpers 400 and 402, which are attached to the card guide 370 and extend through openings 404 and 406, respectively, of side guide member 374. The card bumpers 400 and 402 operate to press the card 186 against the inside of side guide member 372 and provide the desired accurate positioning of the card relative to the printed transfer panel 130 of the transfer ribbon 114.

The card 186 is eventually fed through a card discharge end 408 and on to the heated transfer roller 180 of the image transfer section 106. A slot 410 is formed in the plate 378, through which the platen 182 extends. The printed image on a panel 130 of the transfer ribbon 114 is aligned with the card 186 using the card sensor 371 and the ribbon sensor 252, as described above. The card 186 is fed between the printed panel 130 and the platen 182 as heat and pressure is applied by the heated transfer roller 180 to transfer the image to the surface 188 of the card 186.

The printed card 186 is received by feed rollers 185 at a second card guide 411 from the heated transfer roller 180 and preferably fed to a card bender, as will be discussed below.

Card Bender

Figure 18:
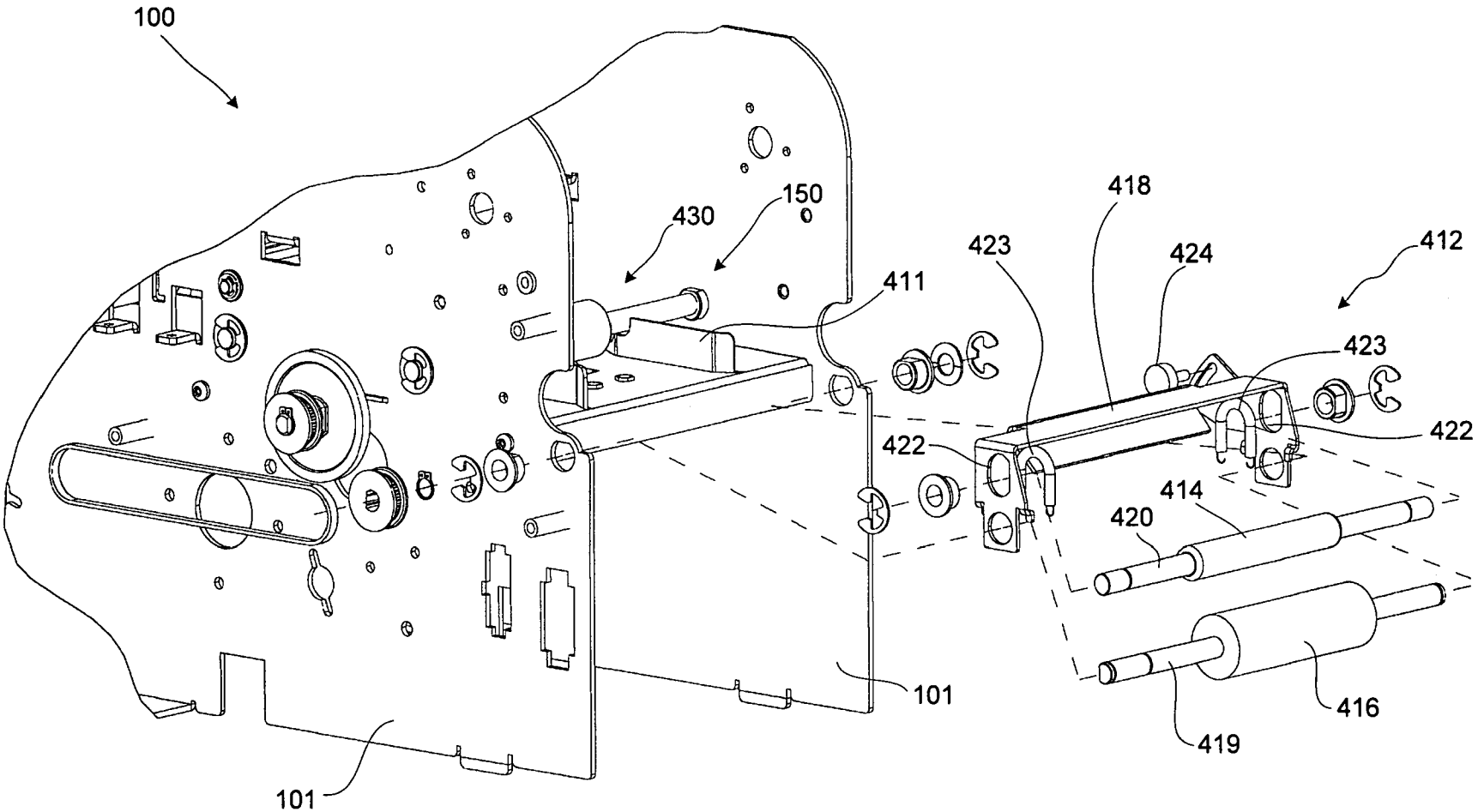
FIG. 18 is an exploded perspective view of a card bender in accordance with embodiments of the invention.

The transferring of the image from the printed transfer ribbon panel 130 to the surface 188 of the card 186 causes the card 186 to bend such that the surface 188 becomes concave. One embodiment of printer 100 includes a card bender 412, which is shown assembled in FIGS. 3 and 13. FIG. 18 is an exploded perspective view of the card bender 412 at the card output 150 of the printer 100. The card bender 412 is configured to receive the bent card 186 and straighten the card 186 by temporarily reversing the bend (i.e., temporarily making surface 188 convex).

Card bender 402 generally includes first and second rollers 414 and 416 that form a pinch roller pair. The first roller 414 is positioned above the second roller 416, either of which can be driven by a motor 417. A bracket 418 mounts to the axle 419 of the second guide roller 416 and supports the axle 420 of the first guide roller 414 in slots 422 for slidable movement away from and toward second guide roller 416. In accordance with one embodiment of the invention, a biasing mechanism, such as springs 423 or other suitable members, bias the first roller 414 toward the second roller 416, while allowing the first roller 414 to deflect slightly away from the second roller 416 in order to receive the card 186.

The bracket 418 can be rotated about the axle 419 of the second guide roller 416 to change the angular position of the first roller 414 relative to the second roller 416. The bracket 418 can be secured in place by a thumb screw 424 (FIG. 18) that attaches the bracket 418 to the side wall 101 of the printer frame, or otherwise fixed in a desired position. A plane 426 that extends parallel to an through the axes of rotation of the first and second rollers 414 and 416 is at an angle 428 that is non-perpendicular to the substantially horizontal card path 146 that is aligned at the output 150 with the tangent of both the feed rollers 185 of the pinch roller pair or assembly 430, as shown in FIG. 3. As the bracket 418 is rotated in the direction indicated by the arrow 432 (FIG. 3) the more severe the downward bend the card bender 412 will apply to the card 186 as the card 186 is discharged along the tangent to both the first and second rollers 414 and 416, or perpendicularly to the plane 426.

In operation, the card bender 412 receives the bent card 186, which is aligned by the card guide 411 and fed by the pinch rollers 185 or other feed mechanism near the output 150. While the trailing portion of the card 186 is still in the grasp of the pinch roller assembly 430, or maintained in the card path 146 by another suitable card support, the leading portion of the card 186 is directed downwardly in accordance with the angle 428. When adjusted properly, the card bender 412 will eject a substantially straight card 186. The card 186 can then be discharged through the output 150 and into a card hopper or passed to another card processing device for additional processing.

Although the present invention has been described with reference to preferred embodiments, workers skilled in the art will recognize that changes may be made in form and detail without departing from the spirit and scope of the invention.

What is claimed is:

1. A card printer comprising:

a print platen comprising an axle;

a first support that is moveable between print and withdrawn positions, the first support comprising an axle receiver configured to engage the axle of the print platen and limit a minimum spacing between the first support and the print platen;

a printhead moveably mounted to the first support for movement between a forward position and a floating position relative to the first support; and a biasing mechanism configured to apply a biasing force to bias the printhead toward the forward position.

2. The printer of claim 1, wherein the printhead includes a plurality of resistive heating elements that face the print platen.

3. The printer of claim 1, including a second support, to which the printhead is mounted, the second support moveably mounted to the first support and configured for movement between the forward and floating positions.

4. The printer of claim 3, wherein first support includes a pair of side walls each having a slot and the second support includes a cross member that extends through the slots of the side walls, wherein the slots limit the movement of the second support relative to the first support and define the forward position.

5. The printer of claim 3, wherein the biasing mechanism includes a spring member mounted to the first support member and engaging one of the second support member and the printhead.

6. The printer of claim 1, wherein the biasing mechanism controls a pressure applied to the print platen by the printhead when in the floating position.

7. The printer of claim 1, including a stop member that limits the forward position of the printhead.

8. The printer of claim 7, wherein the first support is in the print position and the printhead is displaced from the forward position and the stop member when the printhead is in the floating position.

9. The printer of claim 1 including a motorized head lift configured to move the first support between the print and withdrawn positions.

10. The printer of claim 9, wherein the motorized head lift includes a rotatable cam member that contacts a cam follower.

11. The printer of claim 1, wherein the print platen is positioned above the printhead.

12. The printer of claim 2 including a print ribbon supported between the platen and the printhead.

13. The printer of claim 12 including, a transfer ribbon between the print ribbon and the platen.

14. A card printer comprising:

a platen comprising an axle;

a first support that is moveable relative to the platen between a print position and a withdrawn position, the first support comprising an axle receiver configured to engage the axle of the print platen and limit a minimum spacing between the first support and the print platen;

a printhead mounted to the first support, wherein the printhead applies a pressure to the platen when the first support is in the print position and is displaced from the platen when the first support is in the withdrawn position;

a cam member engaging the first support and configured to move the first support between the print and withdrawn positions in response to rotation of the cam member; and a motor configured to drive rotation of the cam member.

15. The printer of claim 14, wherein the printer further comprises:

a second support moveably mounted to the first support for movement relative to the first support between forward and withdrawn positions, wherein the second support is positioned more toward the platen relative to the first support when in the forward position than when the second support is in the floating position; and a biasing mechanism that biases the second support toward the forward position.

16. The printer of claim 15, wherein first support includes a pair of side walls each having a slot and the second support includes a cross member that extends through the slots of the side walls, wherein the slots limit the movement of the second support relative to the first support and define the forward position.

17. The printer of claim 14, wherein the first support moves linearly toward and away from the platen in response to rotation of the cam member.

* * * * *